US005584984A

United States Patent [19]

Pempera et al.

[11] Patent Number: 5,584,984

[45] Date of Patent: Dec. 17, 1996

[54] METHOD AND APPARATUS FOR ELECTROLYTIC TREATMENT OF A SURFACE

[75] Inventors: Franz G. Pempera, Neuwied; Michael Haentjes, Essen, both of Germany

[73] Assignee: Mannesmann Aktiengesellschaft, Düsseldorf, Germany

[21] Appl. No.: 499,429

[22] Filed: Jul. 7, 1995

[30] Foreign Application Priority Data

Jul. 7, 1994 [DE] Germany ..... 44 25 854.2

[51] Int. Cl.[6] ..... C25F 1/00; C25F 7/00

[52] U.S. Cl. ..... 205/704; 204/206; 204/269; 204/273

[58] Field of Search ..... 204/140, 206, 204/273, 268, 269; 205/77, 138

[56] References Cited

U.S. PATENT DOCUMENTS

| | | | |
|---|---|---|---|
| 2,165,326 | 7/1939 | Yerger et al. | 204/269 X |
| 3,558,460 | 1/1971 | Uchida et al. | 205/138 X |
| 3,926,767 | 12/1975 | Brendlinger et al. | 204/206 |
| 4,264,416 | 4/1981 | Noz | 204/206 X |
| 4,272,334 | 6/1981 | Fukuda et al. | 204/206 X |
| 4,601,794 | 7/1986 | Tsuda et al. | 204/206 X |

*Primary Examiner*—Donald R. Valentine
*Attorney, Agent, or Firm*—Cohen, Pontani, Lieberman, Pavane

[57] ABSTRACT

A process and apparatus for electrolytically treating a surface, as for pickling, cleaning and/or degreasing a high-speed continuous metal strip. The strip to be treated is passed through a container holding an electrolyte and including strip electrodes disposed in confrontingly-spaced relation above and below the movement path of the strip. The electrodes are arranged along the movement path in serial adjacency so that each electrode is disposed immediately adjacent to an opposite polarity electrode along the path. Electrolyte is applied to the strip by a number of nozzle pairs, each pair being associated with and arranged on opposite sides of a respective electrode and acting on a region of the strip confrontingly opposite that electrode so as to prevent the electrolyte from entering gap regions defined between adjacent electrodes. This arrangement avoids short circuits through the electrolyte between adjacent, opposite charge electrodes.

10 Claims, 1 Drawing Sheet

METHOD AND APPARATUS FOR ELECTROLYTIC TREATMENT OF A SURFACE

BACKGROUND OF THE INVENTION

1. Field of the Invention

The present invention relates to a process and apparatus for electrolytic treatment of a surface and, more particularly, to a process and apparatus which minimizes both treatment time and contamination of the electrolytes.

2. Description of the Related Art

Systems for electrolytic treatment of a surface, especially of a metal strip, are well known. Such systems include at least one container holding an electrolyte through which the strip runs horizontally. Anodic connected and cathodic connected electrodes are arranged above and below a path defining a direction of movement of the strip through the device in alternating fashion one behind the other. These systems are especially useful in pickling, cleaning and degreasing the strip.

A known device of this type is described in European Patent Application No. 02 35 595 and is used for cleaning the surfaces of metal strips. This device is employed in combination with mechanical components that act on the strip surface.

Usually, the entire electrolytic process is carried out in at least one container which contains the electrolyte needed to perform the process. The electrolyte is customarily supplied to the container by pumps.

The electrodes arranged above and below the strip are generally designated as the working electrodes to which the strip acts as a counter-electrode; the method of operation of a device using such an arrangement is referred to as the middle conductor process. As is known, when the electrodes on both sides of the strip have the same polarity all points on the strip surface, regardless of which strip side they lie on, also have the same polarity —i.e. if all of the working electrodes are positive-connected (anodic) then the strip surface acts as a negative pole (cathode) and vice versa.

In prior art processes and devices the current flows not only directly to the strip but also from one working electrode to the next through the electrolyte, thereby forming a short circuit or bridge between adjacent electrodes. Thus, these processes and devices suffer from the loss of a considerable portion of the available electrolytic current due to the short circuit and, in addition, this current is not effective for treatment of the surface as is known from Kirchhoff's Law. Another disadvantage of prior art devices is that when several electrodes are arranged next to one another in alternating order (i.e. anode/cathode/anode...), the electrolyte becomes evenly contaminated with the product being removed from the strip. Furthermore, currently-known devices are also unable to provide an electrolytic cascade.

FIG. 2 shows a prior art device for electrolytic treatment of a surface including a container 1 through which the strip 2 to be treated extends in a substantially horizontal orientation. At the entrance and exit of the container 1 are deflector and guide rollers 3, 4 which supportingly define the position of strip 2 in container 1. Anodic connected 5 and cathodic connected 6 working electrodes are arranged above and below the strip 2 in alternating order along the longitudinal direction of the strip 2.

Short-circuit currents 7 may travel between adjacent cathode connected and anode connected electrodes with the electrolyte acting as a bridge therebetween. These short-circuit currents limit the efficiency of the treatment process as the currents should flow between the working electrodes 5, 6 and the strip 2 to the greatest extent possible for full effectiveness as discussed hereinabove.

It would therefore be desirable to provide a process and apparatus for electrolytically treating a surface which eliminates the formation of short circuit currents between adjacent opposite-polarity electrodes. It would be further advantageous to minimize contamination of the electrolyte by the product being removed from the strip.

SUMMARY OF THE INVENTION

It is accordingly an object of the present invention to provide a process and apparatus for electrolytically treating a surface in a minimum amount of time and with minimal contamination of the electrolytes.

It is a further object of the present invention to provide a process and apparatus for electrolytically treating a surface and which eliminates the formation of short circuits between adjacent opposite-polarity electrodes.

The present invention provides a process and apparatus for electrolytically treating a surface, especially suitable for pickling, cleaning and degreasing high-speed continuous metal strips. A strip to be treated is passed through a container holding an electrolyte and including strip electrodes arranged respectively above and below the path of the strip. The electrodes are arranged one behind another in an alternate anode connected — cathode connected alignment along the movement direction of the strip. Electrolyte is applied to the strip by a plurality of nozzle pairs, each pair being associated with a respective electrode and acting on a region of the strip proximate which that electrode is positioned. Electrolyte is prevented from entering regions between adjacent differently connected or charged electrodes of the strip and the area along both the top and bottom sides or faces of the strip is kept free of electrolytes as a result of the working relationship formed between the nozzles of each pair.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, in which like numerals denote similar elements throughout the several views.

DETAILED DESCRIPTION OF THE PRESENTLY PREFERRED EMBODIMENTS

Figure 2:
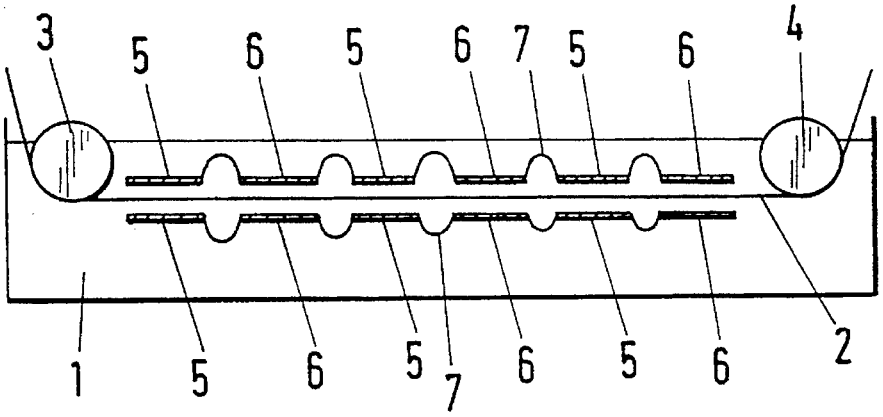
Fig.2 (PRIOR ART)
FIG. 2 is a schematic side view of a prior art device for electrolytically treating a surface.
Figure 1:
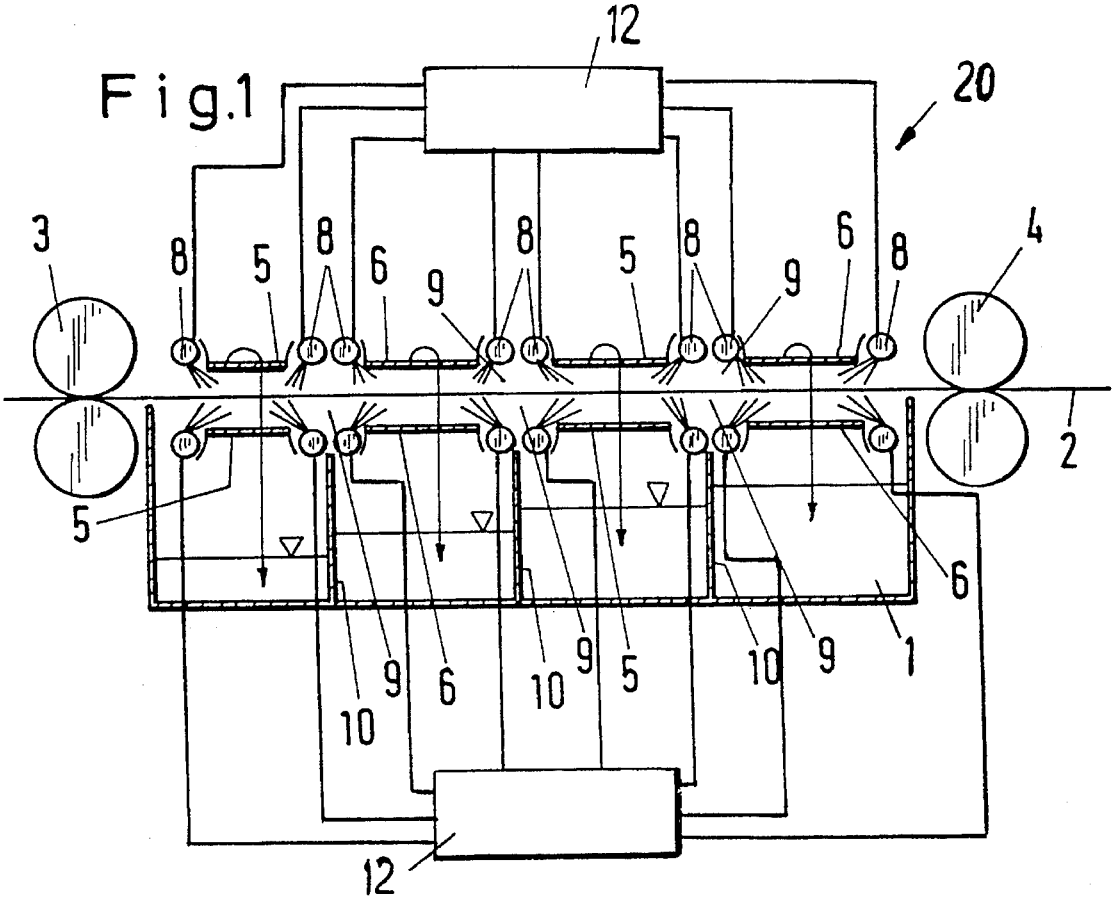
FIG. 1 is a schematic side view of a device for electrolytically treating a surface in accordance with the present invention.

FIG. 1 depicts a device for electrolytic treatment of a surface in accordance with the present invention and indicated by the general reference numeral 20. The device 20 is especially well-suited for pickling, cleaning and degreasing high-speed continuous metal strips 2, such as a cold-rolled steel strip although any other type of metal strip may alternatively be treated. The device 20 of this embodiment includes a single container 1 defining a substantially horizontal path along which the strip 2 travels. Located at the entrance and exit to the container 1 are deflector and guide rollers 3, 4 which predeterminately position the strip 2 within the container 1.

Arranged both above and below the strip 2 and along the path defined by the container 1 and rollers 3, 4 are working electrodes 5, 6; the anodic-connected electrodes are identified by reference numeral 5 and the opposite polarity cathodic-connected electrodes by reference numeral 6. The individual anodic and cathodic connected electrodes 5, 6 are alternately disposed along the path between the rollers 3, 4 defining the direction of movement of the strip 2 to define an upper electrode segment above the strip and a lower electrode segment below the strip.

A pair of nozzles 8 are associated with each working electrode 5, 6. One such nozzle 8 is positioned in front of and one nozzle 8 is positioned behind each respective working electrode 5 and 6 in the moving direction of the strip 2. Each nozzle bar 8 is, in addition, oriented obliquely towards its respective working electrode and is inclined towards a surface of the strip 2. A stream of electrolyte is sprayed or directed onto the surface of the strip 2 through each nozzle 8, each pair spraying from a position beneath (relative to the strip) the respective electrode and acting together to keep the electrolyte within a region of the strip most closely proximate that working electrode to thereby prevent or discourage electrolytes from entering a gap region 9 defined between immediately adjacent working electrodes. Because the electrolytes are prevented from entering the gap regions between adjacent electrodes, impurities are prevented from being transported along the strip 2 to regions proximate adjacent electrodes. The electrolytes are effectively forced from the gap regions 9 between adjacent electrodes as a result of the orientations of the nozzles 8 of each pair.

The spraying of the electrolytes from the nozzles 8 creates a turbulence between the working electrodes 5, 6 and the strip 2 which facilitates the transfer of current through the electrodes, thereby improving the treatment of the surfaces of the strip 2. The quantity of the electrolyte and the pressure at which it is sprayed by the nozzles 8 is preferably adjustable to assist in guiding the strip along the path and between the electrodes. In order to adjust the quantity of the electrolyte and the pressure at which it is sprayed, an adjusting device 12 may be attached to the nozzles 8. The adjusting device 12 is operable to vary the pressure and/or rate or volume at which the electrolyte is sprayed from both above and below the interposed strip for selective and further guiding of the strip 2 through the container relative to the electrodes 5, 6. The distance between the strip 2 and electrodes 5, 6 may also be varied by changing the volume or rate and/or pressure at which the electrolyte is sprayed; the minimum distance between the strip 2 and electrodes 5, 6 is generally intended to be in the range of approximately 20–60 mm.

Separating walls 10 are also provided for subdividing the container 1 into a plurality of spaces or portions or cells. Separating walls 10 are positioned on either side of a pair of nozzles 8 associated with an individual electrode. Therefore, each working electrode, the corresponding working electrode located in confronting opposition to the opposite side or face of the strip 2, and the two respective nozzle pairs 8 are associated with a particular container cell defined between two separating walls 10. The subdividing of the container 1 into such cells limits contamination of the electrolytes in each region below the particular working electrodes. As a result, the exit side container cells are kept cleaner as the contaminated particles are removed from the strip 2 prior to reaching these regions and, thus, the surface treatment of the strip is more effective than is provided by the prior art. With respect to the content materials, a cascade is begun which simplifies subsequent treatment of run-offs from (for example) the pickling solution, in that the sediments and the like to be separated from the strip are already concentrated. This run-off is illustrated in FIG. 1 by the arrows extending from the electrodes 5, 6.

In operation, the strip 2 is advanced along the path defined through the container 1 extending between the deflector and guide rollers 3, 4. Adjacent opposite sides or faces of the strip 2 are positioned alternating anodic and cathodic connected electrodes 5 and 6, and beneath the strip 2 separating walls 10 divide the container into a plurality of separate cells.

As the strip 2 passes interposedly between the electrodes 5, 6, respective pairs of nozzles 8 spray electrolyte on the strip 2 to treat the strip. The orientation of the nozzles 8 of each pair assures that only the area of the strip 2 passing by the respective electrode is treated by the electrolyte, the nozzles 8 of each pair acting together to prevent entry of electrolyte into the gap region 9 defined on either side of the respective electrode. Furthermore, electrolytes sprayed by the nozzles 8 which impact the strip 2 and are contaminated by the product being removed from the strip run off from the strip 2 and into the container cells formed by the separating walls 10.

As a consequence of the predeterminately directed spray of the nozzle pairs and the corresponding container cells into which the contaminated electrolyte runs off, contaminated electrolyte is prevented from travelling along the strip 2 into the gap regions 9 between adjacent electrodes and, likewise, to the region beneath an adjacent electrode. Preventing the electrolyte from entering the gap region 9 between adjacent electrodes prohibits the formation of short circuits between confrontingly-opposed electrodes, as previously discussed, and increases the operating effectiveness of the inventive device as the electric current is prevented from flowing from one working electrode to the next and thereby provides maximized electrical effectiveness of the treatment of strip 2. The surface treatment is also rendered more effective in that contaminants and contaminated electrolytes do not remain attached to the strip 2 and thereby require further cleaning by a subsequent electrode 5, 6 and nozzle pair 8 downstream along the transport path. As the treatment in each region is more effective, the treatment speed and productivity of the device are also increased.

Thus, the present invention operatively ensures that the gap regions 9 between the working electrodes 5, 6 are kept free of electrolyte so that short-circuit currents are effectively unable to flow between adjacent working electrodes, thereby providing maximized electrical effect for the treatment of the strip. As a result, it is possible to not only improve the quality of the surface treatment process, but to also increase the treatment speed and thus raise the productivity of the device and method.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method of electrolytically treating a surface of an elongated, continuous metal strip advanced longitudinally along a direction of movement, comprising the steps of:

passing the strip along said movement direction through a container between strip electrodes disposed in the container confrontingly at a distance from one another and along said movement direction so that the strip is passed between an upper electrode segment and a lower electrode segment disposed confrontingly-opposite respectively opposite faces of the strip, each of the upper and lower electrode segments comprising a plurality of individual strip electrodes disposed in serial adjacency along said movement direction so that each said individual strip electrode of each of the upper and lower electrode segments is disposed immediately-adjacent an adjacent individual strip electrode of the said each upper and lower electrode segment with each said individual strip electrode having a polarity opposite said adjacent individual strip electrode; and applying a surface-treating electrolyte to the strip so that a gap region defined between each said individual strip electrode and an immediately-adjacent adjacent individual strip electrode is maintained sufficiently free of electrolyte as to prevent a passage of charge, through the electrolyte, between each said individual strip electrode and the immediately-adjacent individual strip electrode between which the gap region is defined, said applying step including directing a stream of liquid electrolyte onto a confrontingly-opposed surface of the strip from a location closely proximate the gap region and in a direction oriented angularly away from the gap region and toward an immediately-adjacent one of said individual strip electrodes.

2. A method of electrolytically treating a surface in accordance with claim 1, wherein said applying step further comprises directing a stream of liquid electrolyte onto a confrontingly-opposed surface of the strip from a pair of nozzles disposed proximate opposite sides, along said movement direction, of each said individual strip electrode.

3. A method of electrolytically treating a surface in accordance with claim 1, wherein said applying step further comprises directing a stream of liquid electrolyte onto a confrontingly-opposed surface of the strip from a pair of nozzles disposed proximate opposite sides, along said movement direction, of each said individual strip electrode and oriented so that each nozzle directs a stream of liquid electrolyte from a location proximate one of the gap regions at an angle obliquely toward said each said individual strip electrode and the confrontingly-opposed surface of the strip.

4. A method of electrolytically treating a surface in accordance with claim 1, wherein said passing step further comprises passing the strip along said movement direction in an undeflected, substantially horizontal orientation through the container between the upper and lower strip electrode segments.

5. A method of electrolytically treating a surface in accordance with claim 1, wherein said applying step further comprises applying a liquid electrolyte to the strip from proximate both the upper and lower strip electrode segments at at least one of a pressure and a rate selected so as to guide the strip between the upper and lower strip electrode segments.

6. A method of electrolytically treating a surface in accordance with claim 5, further comprising the step of selectively varying at least one of the pressure and rate so as to selectively guide the strip relative to the upper and lower strip electrode segments.

7. A device for electrolytically treating a surface of an elongated, continuous metal strip advanced longitudinally along a direction of movement, comprising: a container defining a path for longitudinal movement of the strip through the container; a plurality of individual strip electrodes disposed in the container in confrontingly spaced relation to the strip and along the strip path to form an upper electrode segment and a lower electrode segment disposed confrontingly-opposite respectively opposite faces of the strip, said individual strip electrodes of each of said upper and lower electrode segments being disposed in serial adjacency along the path so that each individual strip electrode of said upper and lower electrode segments is disposed immediately adjacent an adjacent individual strip electrode of said upper and lower electrode segment with each said individual strip electrode having a polarity opposite said adjacent individual strip electrode and having a gap region defined between each individual strip electrode and said immediately adjacent strip electrode; and a plurality of nozzles for applying a surface treating electrolyte to the strip, each said nozzle being disposed proximate one of said gap regions and associated with a respective individual strip electrode for operatively spraying the electrolyte onto a confrontingly opposed surface of the strip and in a direction oriented angularly away from the gap region and toward the respective individual strip electrode.

8. The device of claim 7, wherein a pair of said plural nozzles are disposed proximate opposite sides, along said movement direction, of each said individual strip electrode in said upper and lower electrode segments, and each said nozzle being oriented to direct a stream of liquid electrolyte from a location proximate one of the gap regions at an angle obliquely toward the respective individual strip electrode and the confrontingly-opposed surface of the strip.

9. The device of claim 7, further comprising means for selectively adjusting at least one of a pressure and a rate at which the electrolyte is sprayed by said nozzles onto the strip so as to guide the strip relative to said upper and lower electrode segments.

10. The device of claim 8, further comprising means for controlling at least one of a pressure and a rate of application of said electrolyte through said plural nozzles onto the strip so as to guide the strip in between said upper and lower strip electrode segments.

* * * * *